US008867748B2

(12) United States Patent
Posa

(10) Patent No.: US 8,867,748 B2
(45) Date of Patent: Oct. 21, 2014

(54) WIRELESS PERSONAL LISTENING SYSTEM AND METHOD

(76) Inventor: John G. Posa, Ann Arbor, MI (US)

( * ) Notice: Subject to any disclaimer, the term of this patent is extended or adjusted under 35 U.S.C. 154(b) by 254 days.

(21) Appl. No.: 13/329,397

(22) Filed: Dec. 19, 2011

(65) Prior Publication Data

US 2012/0155649 A1 Jun. 21, 2012

Related U.S. Application Data

(60) Provisional application No. 61/425,368, filed on Dec. 21, 2010.

(51) Int. Cl.
*H04H 20/48* (2008.01)
*H04H 20/61* (2008.01)

(52) U.S. Cl.
CPC ..... *H04H 20/61* (2013.01)
USPC ..... 381/3; 381/74; 381/309; 381/311; 381/80; 455/569.1; 455/575.2

(58) Field of Classification Search
USPC ..... 381/74, 1, 2, 3, 6, 10, 11, 13, 16, 17, 381/18, 22, 23, 23.1, 300, 302, 303, 309, 381/310, 311, 61, 312, 313, 314, 322, 323, 381/328, 329, 71.6, 71.7, 72, 79, 80, 81, 381/120, 104, 28, 107, 106; 455/569.1, 455/569.2, 575.2, 41.1, 41.2, 42
See application file for complete search history.

(56) References Cited

U.S. PATENT DOCUMENTS

| | | | |
|---|---|---|---|
| 3,590,382 | A | 6/1971 | Kenney |
| 6,118,882 | A | 9/2000 | Haynes |
| 6,339,696 | B1 | 1/2002 | Chan et al. |
| 6,424,820 | B1 | 7/2002 | Burdick et al. |
| 6,519,448 | B1 | 2/2003 | Dress et al. |
| 6,782,239 | B2 | 8/2004 | Johnson et al. |
| 7,110,798 | B2 | 9/2006 | Nassimi |
| 7,272,421 | B2 | 9/2007 | Bang et al. |
| 7,292,881 | B2 | 11/2007 | Seil et al. |
| 7,474,757 | B2 | 1/2009 | Cohen et al. |
| 7,620,433 | B2 | 11/2009 | Bodley |
| 7,657,024 | B2 | 2/2010 | Huang |
| 7,734,256 | B2 | 6/2010 | Seil et al. |

(Continued)

FOREIGN PATENT DOCUMENTS

| | | |
|---|---|---|
| EP | 1196007 | 4/2002 |
| EP | 1715718 | 10/2006 |

*Primary Examiner* — Leshui Zhang
(74) *Attorney, Agent, or Firm* — Gifford, Krass, Sprinkle, Anderson & Citkowski, P.C.

(57) ABSTRACT

A personal listening system uses the FM broadcast band for transmission and reception. The system includes a base unit and physically separate right- and left-ear listening units. The base unit includes an FM stereo transmitter. Each listening unit demodulates and amplifies the received signal, but the right-ear unit only amplifies the right channel and the left-ear unit only amplifies the left channel. The base unit may be a digital music player, book reader, video player, smart cellular telephone, or any other portable device. The base unit may include a display for displaying the selected FM frequency. The base unit may be a self-contained or integrated unit, or a device that couples to a digital music player, smart cellular telephone or other device to receive the audio signal therefrom. The right- and left-ear listening units may be any type of on-ear, in-ear or around-ear sound delivery devices including earbuds.

20 Claims, 4 Drawing Sheets

(56) References Cited

U.S. PATENT DOCUMENTS 7,761,091 B2 7/2010 Dunn, Jr. et al.
2008/0076489 A1* 3/2008 Rosener et al. ..... 455/575.2
2009/0046869 A1* 2/2009 Griffin et al. ..... 381/74
2009/0116671 A1* 5/2009 Barwick et al. ..... 381/315

* cited by examiner

WIRELESS PERSONAL LISTENING SYSTEM AND METHOD

REFERENCE TO RELATED APPLICATION

This application claims priority from U.S. Provisional Patent Application Ser. No. 61/425,368, filed Dec. 21, 2010, the entire content of which is incorporated herein by reference.

FIELD OF THE INVENTION

This invention relates generally to portable electronic devices and, in particular, to a wireless listening system and method that uses the standard FM band for transmission and reception.

BACKGROUND OF THE INVENTION

Portable music players such as MP3 players have become very popular. One problem is that the cords going from the music player to the earbuds or headphones can get in the way or become tangled, especially with activities such as jogging.

There are wireless earbuds but they are expensive and limited in functionality. Sennhieser, for example, now offers a system called the MX W1 that retails for about $500 and uses a small transmitter to send modulated audio signals to wireless in-ear receivers. While the system is digital and no doubt offers high quality sound reproduction, the transmitter is somewhat large and the receivers can only be used with that transmitter.

SUMMARY OF THE INVENTION

This invention is directed to a personal listening system which, in the preferred embodiments, uses the standard FM band for transmission and reception. This offers significant advantages, including the fact that the earbuds or other listening units can be used as an independent FM stereo receiver without the need for the local transmitter, thereby freeing up the music player for other purposes such as book reading, video watching, telephonic communications, and so forth.

The system includes a base unit and physically separate, entirely self-contained, battery-operated right- and left-ear listening units. The base unit includes a source of an audio signal, a user control for selecting an FM frequency, and an output for outputting a signal representative of the selected FM frequency. The base unit further includes a modulator for modulating the audio signal onto the selected FM frequency as a stereo signal with encoded right and left channels, and an FM stereo transmitter for wirelessly transmitting the modulated audio signal over the selected FM frequency.

Each listening unit includes an input for receiving the signal representative of the selected FM frequency, an FM stereo tuner, and apparatus for tuning the FM tuner to the selected FM frequency of the base unit. Each listening unit further includes a demodulator for demodulating the audio signal from the selected FM frequency, an amplifier for amplifying the audio signal, and a transducer for converting the audio signal into sound to be heard by a listener. In accordance with the invention, however, the right-ear unit only amplifies the right channel of the FM stereo signal, and the left ear unit only amplifies the left channel of the stereo signal.

The base unit may be a digital music player, book reader, video player, smart cellular telephone, or any other portable device with a stereo sound generator. The base unit may further include a display for displaying the selected FM frequency. The base unit may be a self-contained or integrated unit or a device that couples to a digital music player, smart cellular telephone or other base unit to receive the audio signal therefrom.

The right- and left-ear listening units may be any type of on-ear, in-ear or around-ear sound delivery devices including "earbuds," headphones or earphones. The right- and left-ear units may physically dock onto the base unit to receive the signal representative of the selected FM frequency from the base unit, in which case the base unit may recharge the batteries in the right and left ear units while docked. The right- and left-ear units may receive the signal representative of the selected FM frequency from the base unit through a wireless or wired connection such that the wires deliver the audio signal directly to the right and left ear units while interconnected. The wires may also recharge the batteries in the listening units while connected.

The right- and left-ear units may receive the signal representative of the selected FM frequency from the base unit through a wireless Bluetooth connection or other short-range broadcast at a frequency other than the selected FM frequency. Alternatively, the listening units may receive the signal representative of the selected FM frequency from the base unit through a radio frequency.

DETAILED DESCRIPTION OF THE INVENTION

This invention resides in a wireless listening system which, in the preferred embodiments, uses the standard FM band for transmission and reception. This offers significant advantages, including the fact that the in- or on-ear units can be used as an independent FM stereo receiver without the need for the local transmitter, thereby freeing up the music player for other purposes such as book reading, video watching, telephonic communications, and so forth.

As used herein, "earbuds" should be taken to include any type of on-ear, in-ear or around-ear sound delivery devices including 'headphones,' 'earphones,' and the like, so long as the right- and left-ear components can be entirely wireless as described herein. Also "music player" should be understood to include any kind of portable electronic device that uses or would benefit from stereophonic listening, including radios, telephones, video players, book readers, and so forth. Further, although the preferred embodiments use FM stereo, the invention does not preclude over broadcasts, including AM, TV audio, shortwave, or satellite reception.

Figure 1A:
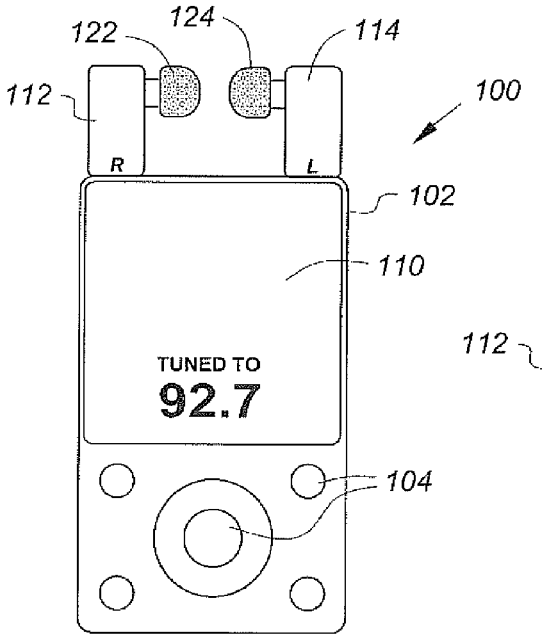
FIG. 1A illustrates a preferred embodiment of the invention.

FIG. 1A illustrates a preferred embodiment of the invention generally at 100. The system includes a source of an audio signal such as music player 102. In the embodiment of FIGS. 1A-1D, the unit 102 includes an FM stereo transmitter that sends the same signal 120 to right earbud 112 and left earbud 114. The unit 102 may also include a display 110 and a user control 104. Earbud 112 may include an in-ear tip 122, and earbud 114 may include ear tip 124. Both earbuds 112, 114 include FM receivers, demodulators and audio amplifiers, but in the case of a stereo transmission, the right earbud only delivers right-channel audio to the right ear and the left earbud only delivers left-channel audio to the left ear.

Figure 1B:
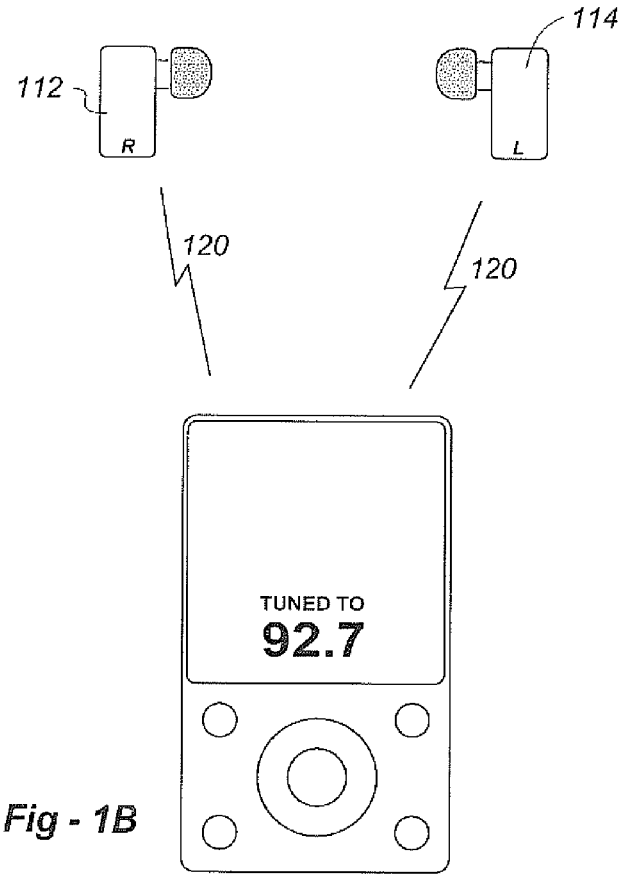
FIG. 1B shows listening units removed to receive FM stereo sound from a base unit.

FIG. 1A shows the listening units 112, 114 docked to the audio player 102 through electrical connections not shown. Using the controls 104, the user has selected an unused FM frequency, in this case, 92.7 MHz. Through the docking connections, the units 112, 114 are now programmed to receive audio modulated over this selected FM frequency, which is also shown on the display. When the units 112, 114 are removed, as shown in FIG. 1B, the user can listen to the audio transmitted by the base unit 102 over the selected FM frequency. Again, the right unit 112 only delivers right-channel audio to the right ear and the left unit 114 only delivers left-channel audio to the left ear.

Each earbud may have nearly identical circuitry, preferably using a single-chip FM stereo circuit such as the TEA5990 FM-RDS chip set from NXP Semiconductors (The Netherlands), which offers reception over a wide tuning range (70 to 108 MHz, including the 70-MHz China band) with Stereo Noise Cancelling (SNC) as well as built-in Auto Search and Store for up to 32 channels with dynamic adjacent channel suppression. The chip also supports the I2C-bus and the SPI-bus (3- or 4-wire format), while a digitally controlled algorithm facilitates seamless coexistence with GSM, Bluetooth, Wi-Fi and WiMAX. Although the TEA5990 chip outputs both right and left audio channels, each listening unit according to the invention would require only one audio amplifier, such the unit for the right ear only amplifies the right channel and the using for the left ear only amplifies the left channel.

Figure 1C:
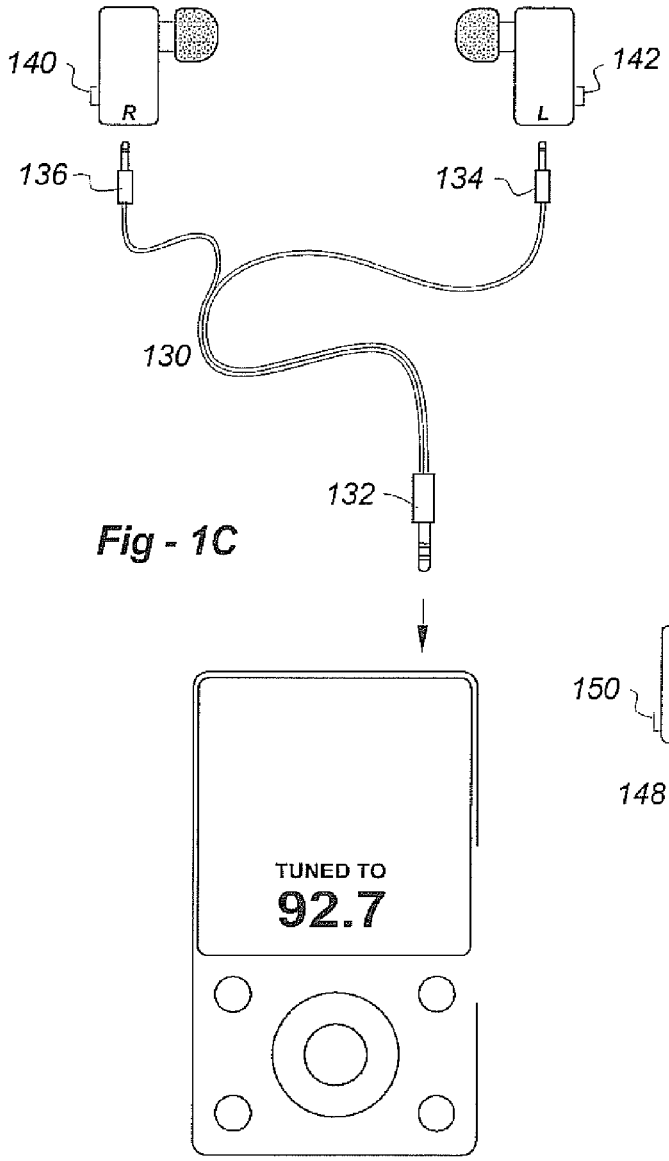
FIG. 1C illustrates an alternative docking mechanism.

FIG. 1C illustrates an alternative docking mechanism. In this case wiring 130 connects the base unit to the listening devices though connectors 132, 134, 136. This configuration offers the advantage that the cable 130 can be used for a conventional, hard-wired interconnect, facilitating stereo listening without the need for wireless transmission. This may be advantageous in areas where it is difficult or impossible to find a clear, unused FM channel. It is assumed that the listening units are programmed over the wiring 130 when plugged in or perhaps when optional "program frequency" buttons 140, 142 are depressed on the listening units. Regardless, the frequency programming signal is preferably a digitally encoded signal that is delivered to the listening units when initially plugged in or at a time or on a frequency which does not interfere with listening.

In the preferred embodiments each listening unit also includes its own rechargeable battery to power operation. In the embodiments wherein the listening units are physically docked (FIGS. 1A, 1C), the batteries may be recharged while the listening units are docked.

Figure 1D:
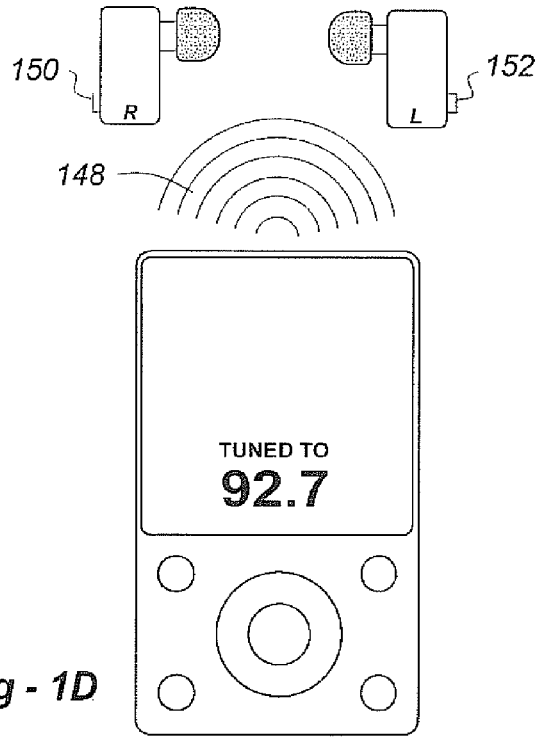
FIG. 1D illustrate yet a further station programming technique according to the invention, in this case a short-range broadcast of the frequency programming signal.

FIG. 1D illustrate yet a further station programming technique according to the invention, in this case a short-range broadcast 148 of the frequency programming signal. Such a signal may be a low-frequency magnetic signal, Bluetooth, or any other short-range transmission. Once the frequency is set on the base unit, optional "program" buttons 150, 152 may be depressed on the listening units. Regardless of the frequency programming method, once the listening units 112, 114 can receive a stereo signal from the base unit, a user can enjoy wireless audio over the selected frequency.

Figure 2:
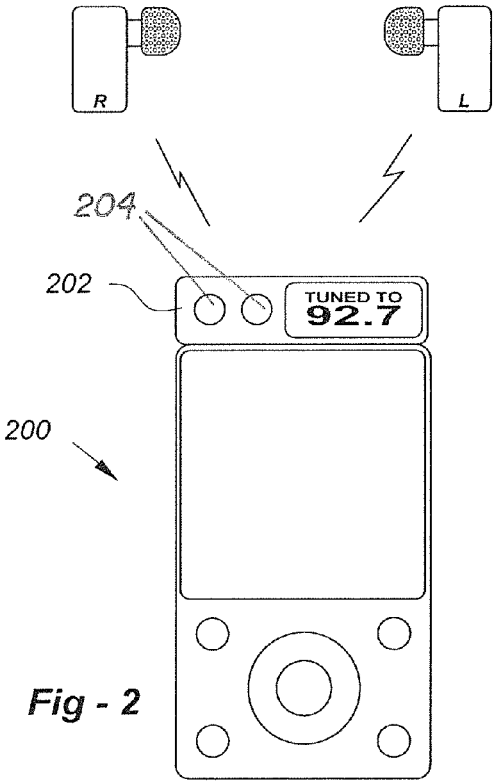
FIG. 2 depicts a separate transmitter used in conjunction with a non-FM-transmitting music player.
Figure 3:
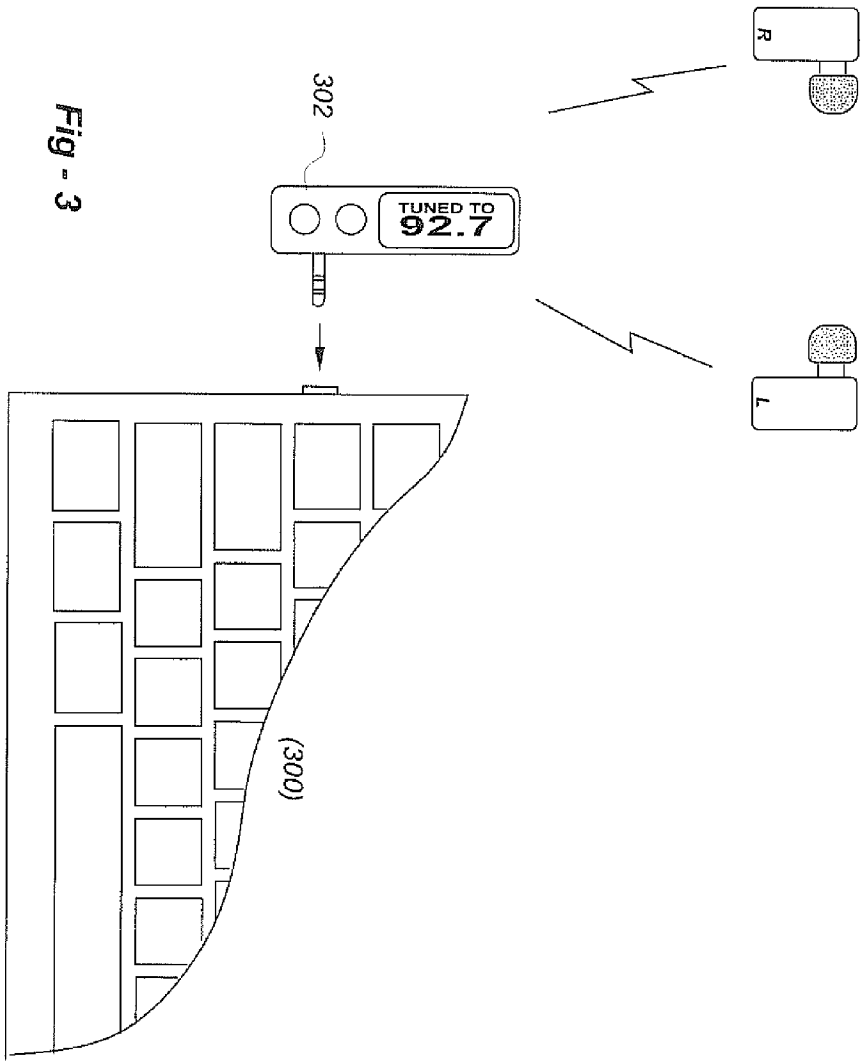
FIG. 3 shows a different configuration wherein the transmitter unit connects to a larger audio source such as a laptop computer.

In some embodiments, the definition of "music player" includes a separate transmitter 202 used in conjunction with a non-FM-transmitting music player 200 shown in FIG. 2. In this case, user controls 204 would be used for frequency programming. Otherwise, operation would be the same as that described with a base unit having a built-in RF transmitter. FIG. 3 shows a different configuration wherein the transmitter unit 302 connects to a larger audio source such as a laptop 300. Such an embodiment is convenient for in-flight movie watching, for example As an alternative to user selection of an unused frequency, the base unit 102 (or 202) may automatically select a "best" unused frequency. For example, the base unit may store a list of unused frequencies as a function of geographical location, with the unit using GPS, WiFi, or cell phone infrastructure to determine location and choose a frequency. The base unit may also test frequencies to find a clear unused channel and use that frequency for programming. This approach offers the advantage of continuing to search for "better" unused frequencies in a background mode and automatically switch to a different frequency if noise is encountered on the currently selected frequency.

Figure 4:
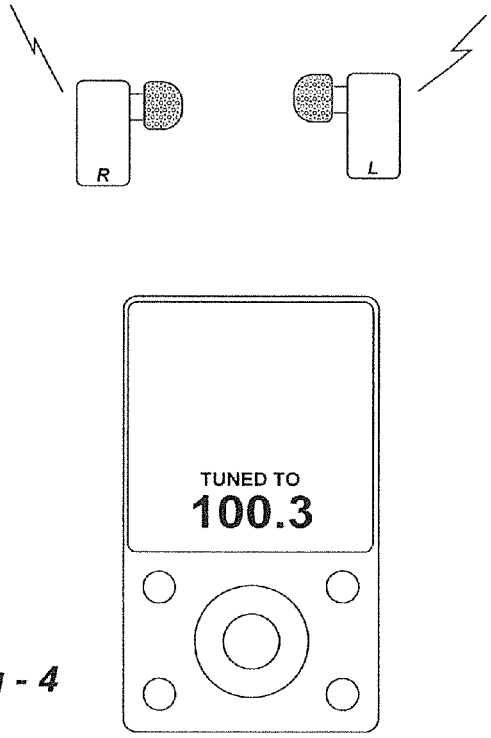
FIG. 4 illustrates how the base unit has been used to program the listening units to an active FM stereo station.

An advantage of the invention is that the user can also program the listening units to receive a desired, active station, in which case the base unit would not to transmit on the selected FM station. This allows a user to listen to an over-air broadcast, including an FM stereo station, without having to carry the base unit. As shown in FIG. 4, the base unit has been used to program the listening units to "100.3," an active FM stereo station. Once programmed, the listening units receive the FM station off-air and not through the base unit, which might jam the signal. When choosing an active signal, the base unit may be instructed not to transmit using the user controls.

I claim:

1. A personal listening system, comprising:

(a) a base unit including:

a source of an audio signal;

a user control for selecting an FM channel;

a modulator for modulating the audio signal onto the selected FM channel to produce a modulated audio signal with encoded right and left stereo channels; and an FM transmitter for wirelessly transmitting the modulated audio signal over the selected FM channel; and (b) physically separate, entirely self-contained, battery-operated right-ear and left-ear listening units worn by a user, each listening unit thereof including:

an FM stereo tuner;

an apparatus for tuning the FM stereo tuner to the selected FM channel to receive the modulated audio signal with the encoded right and left stereo channels;

a demodulator for demodulating the received modulated audio signal modulated onto the selected FM channel to produce a demodulated audio signal;

an amplifier in the right-ear listening unit for amplifying the demodulated audio signal associated with the encoded right stereo channel to produce an amplified audio signal associated with the encoded right stereo channel;

an amplifier in the left-ear listening unit for amplifying the demodulated audio signal associated with the encoded left stereo channel to produce an amplified audio signal associated with the encoded left stereo channel;

a transducer in the right-ear listening unit for converting the amplified audio signal associated with the encoded right stereo channel into sound for the right ear of the user; and a transducer in the left-ear listening unit for converting the amplified audio signal associated with the encoded left stereo channel into sound for the left ear of the user.

2. The personal listening system of claim 1, wherein each listening unit includes an in-ear portion.

3. The personal listening system of claim 1, wherein each listening unit includes:

an in-ear portion; and an around-ear portion to stabilize positioning of each listening unit.

4. The personal listening system of claim 1, wherein the base unit further includes a display for displaying information representative of the selected FM channel.

5. The personal listening system of claim 1, wherein the base unit is a digital music player, book reader, video player, or smart cellular telephone.

6. The personal listening system of claim 1, wherein the base unit is a device that couples to a digital music player, smart cellular telephone or other base unit to receive the audio signal therefrom.

7. The personal listening system of claim 1, wherein:

the base unit includes an output for outputting a signal representative of the selected FM channel; and each listening unit includes an input for receiving the signal representative of the selected FM channel.

8. The personal listening system of claim 7, wherein the right-ear and left-ear listening units physically dock onto the base unit to receive the signal representative of the selected FM channel from the base unit.

9. The personal listening system of claim 7, wherein:

the right-ear and left-ear listening units receive the signal representative of the selected FM channel from the base unit through wires; and the wires deliver the audio signal directly to the right-ear and left-ear listening units while interconnected.

10. The personal listening system of claim 7, wherein:

the right-ear and left-ear listening units receive the signal representative of the selected FM channel from the base unit through interconnecting wires;

the wires deliver the audio signal directly to the right-ear and left-ear listening units while interconnected through the interconnecting wires; and the interconnecting wires also recharge batteries in the right-ear and left-ear listening units while docked.

11. The personal listening system of claim 7, wherein the right-ear and left-ear listening units receive the signal representative of the selected FM channel from the base unit through a wireless connection.

12. The personal listening system of claim 7, wherein the right-ear and left-ear listening units receive the signal representative of the selected FM channel from the base unit through a wireless Bluetooth™ connection or other short-range broadcast at a frequency other than a frequency associated with the selected FM channel.

13. The personal listening system of claim 1, wherein the right-ear and left-ear listening units physically dock onto the base unit to recharge batteries in the right-ear and left-ear listening units.

14. The personal listening system of claim 1, wherein the right-ear and left-ear listening units receive a signal representative of the selected FM frequency from the base unit through a radio frequency (RF) signal.

15. The personal listening system of claim 1, wherein:

the amplifier in the right-ear listening unit only amplifies an audio signal of the encoded right stereo channel for conversion into the sound for the right ear of the user; and the amplifier in the left-ear listening unit only amplifies an audio signal of the encoded left stereo channel for conversion into the sound for the left ear of the user.

16. The personal listening system of claim 1, wherein the right-ear and left-ear listening units may be configured to receive off-air FM stereo broadcasts from transmitters other than the FM transmitter in the base unit.

17. A personal listening system, comprising:

a pair of physically separate, entirely self-contained, battery-operated right-ear and left-ear listening units worn by a user, each listening unit thereof including:

an FM stereo tuner;

an apparatus for tuning the FM stereo tuner to a desired FM channel to receive a signal having right and left stereo audio channels modulated onto the desired FM channel;

a demodulator for demodulating the received signal into right and left stereo audio channels;

an audio amplifier in the right-ear listening unit for amplifying an audio signal of the right stereo audio channel;

an audio amplifier in the left-ear listening unit for amplifying an audio signal of the left stereo audio channel;

a transducer in the right-ear listening unit for converting the amplified audio signal of the right stereo audio channel into sound for the right ear of the user; and a transducer in the left-ear listening unit for converting the amplified audio signal of the left stereo audio channel into sound for the left ear of the user.

18. The personal listening system of claim 17, wherein:

the audio amplifier in the right-ear listening unit only amplifies the audio signal of the right stereo audio channel for conversion into the sound for the right ear of the user; and the audio amplifier in the left-ear listening unit only amplifies the audio signal of the left stereo audio channel for conversion into the sound for the left ear of the user.

19. The personal listening system of claim 17, wherein the right-ear and left-ear listening units are adapted for use with a base unit including:

a source of the audio signal;

a user control for selecting the desired FM channel;

an output for outputting a signal representative of the selected desired FM frequency;

a modulator for modulating the audio signal onto the selected desired FM channel to produce a modulated stereo audio signal with encoded right and left channels; and an FM transmitter for wirelessly transmitting the modulated stereo audio signal with the encoded right and left channels over the selected desired FM channel; and wherein each listening unit includes an input for receiving a signal representative of a frequency of the selected desired FM channel from the base unit.

20. The personal listening system of claim 19, wherein the signal representative of the frequency of the selected desired FM channel is communicated from the base unit to each listening unit through a wired or wireless connection.

* * * * *